US006155858A

United States Patent [19]

Ozawa et al.

[11] Patent Number: 6,155,858

[45] Date of Patent: Dec. 5, 2000

[54] FLOATING ELECTRICAL CONNECTOR

[75] Inventors: Hiroshi Ozawa; Koichi Akiyama; Mitsuyoshi Yamamoto, all of Tokyo, Japan

[73] Assignee: Hirose Electric Co., Ltd., Tokyo, Japan

[21] Appl. No.: 08/904,570

[22] Filed: Aug. 4, 1997

[30] Foreign Application Priority Data

Aug. 8, 1996 [JP] Japan ..... 8-224589

[51] Int. Cl.[7] ..... H01R 13/629

[52] U.S. Cl. ..... 439/248

[58] Field of Search ..... 439/248, 247, 439/246, 252

[56] References Cited

U.S. PATENT DOCUMENTS

| | | | |
|---|---|---|---|
| 4,334,732 | 6/1982 | Roeschlein et al. | 439/248 |
| 4,722,691 | 2/1988 | Gladd et al. | 439/247 |
| 4,738,631 | 4/1988 | Takahashi et al. | 439/248 |
| 5,201,663 | 4/1993 | Kikuchi et al. | 439/248 |
| 5,259,779 | 11/1993 | Ooya et al. | 439/247 |
| 5,306,168 | 4/1994 | Kunishi et al. | 439/248 |
| 5,306,169 | 4/1994 | Fukushima et al. | 439/248 |

*Primary Examiner*—Gary Paumen
*Attorney, Agent, or Firm*—Kanesaka & Takeuchi

[57] ABSTRACT

A floating electrical connector includes a frame-like fixed housing (1) to be secured to a circuit board; a floating housing (2) provided in the fixed housing such that a bottom face of the floating housing is disposed on or near a surface of the circuit board, it is movable relative to the fixed housing in a plane parallel to the circuit board, and that between the fixed and floating housings there is provided a floating space (4) in which the flexible sections are flexed; a plurality of contact elements (3) attached to both the fixed housing and the floating housing and having connection sections (3A1) provided on a side of the fixed housing to be connected to conductors of the circuit board, contact sections (3C) provided on a side of the floating housing for contact with contact elements of a mating connector, flexible sections (Q) provided between the connection and contact sections to make the floating housing movable; and a receiving cavity (2F) provided in the floating housing to receive the mating connector.

2 Claims, 7 Drawing Sheets

FLOATING ELECTRICAL CONNECTOR

BACKGROUND OF THE INVENTION

1. Field of the Invention

The present invention relates to floating electrical connectors.

2. Description of the Related Art

Floating electrical connectors include a fixed housing, a floating housing, and contact elements provided in the housings. The contact elements have an intermediate sections between a connection section on the side of the fixed housing and a contact section on the side of the floating housing to make the floating housing movable.

A plurality of such connectors are mounted on a circuit board and plugged into a plurality of mating connectors on another circuit board while the floating housings absorb errors in the mounting positions of these connectors.

Japanese patent application Kokai No. 310197/94 discloses a connector of this type. As FIG. 6 shows, the connector includes a fixed housing 51, a floating housing 52 provided above the fixed housing 51, and contact elements 53 mounted on both the housings 51 and 52. The contact elements 53 are arranged with a predetermined pitch in a first direction perpendicular to the sheet.

The inside portions 53A of the contact elements 53 are attached to the floating housing 52 while the outside portions 53B are attached to the fixed housing 51 which is fixed on the a circuit board S by soldering or the like. The contact elements 53 have U-shaped portions for attachment to the fixed and floating housing 51 and 53. The inside and outside U-shaped portions are united by an intermediate arm 53C. The intermediate arms 53C are flexible in a second direction parallel to the sheet to make the floating housing movable.

A mating connector (not shown) is plugged into the connector such that the contact portions of the mating connector are brought into contact with the contact portions 54D of the inside portions 53A. If there is an error in the mounting position between the connectors, the intermediate arms 53C are flexed so that the floating housing 52 is moved in the second direction to the correct plugging position.

Japanese patent application Kokai No. 325825/94 discloses another connector such as shown in FIG. 7. The connector includes a fixed housing 61 and a floating housing 62 provided on the shoulder portions of the fixed housing 61 so as to be movable in the second direction. The inside bottom 62A of the floating housing 62 is close to the circuit board S. A plurality of contact elements 63 are arranged in a zigzag fashion with a half pitch offset from each other in the first direction. The contact elements 63 have an outer section 63A, which has a connection portion connected to the circuit board S, attached to an attaching groove of the fixed housing 61 and an intermediate section 63B (and a projection thereon) attached to the floating housing 62. The inside sections of the contact elements are bent in a U-shaped form to provide contact portions 63C.

A mating connector (not shown) is plugging in the cavity of the connector. A positional error is absorbed by a flexible portion between the outside portion 63A and the intermediate portion 63 of the contact element 63.

There is a demand for a low profile connector able to absorb a mounting error. In the connector of FIG. 6, however, the floating housing 52 is provided above the fixed housing 51 so that the distance between the two circuit boards is large. The mobility of the floating housing 52 depends on the flexibility of the intermediate arms 53C which only extend downward from the top of the contact elements 53 so that the amount of flexure in the second direction is small, and little twist is permitted. Consequently, the mobility of the floating housing 52 is small.

In the connector of FIG. 7, the bottom of the floating housing 62 is close to the circuit board P, but the periphery is mounted on the fixed housing 61 so that it is difficult to reduce the height as in the connector of FIG. 6. The mobility of the floating housing 62 depends on the flexibility of a portion between the intermediate portion 63B and the outside portion 62A of the contact elements 63, but the distance between the two portions 63B and 63A is so small that the amount of flexure is small. In addition, the contact elements 63 are so thick in the first direction that little twist is permitted.

Thus, it is difficult to reduce the height of the above two connectors, and the mobility of the floating housing is small. In addition, the floating housing is movable in only the second direction.

SUMMARY OF THE INVENTION

Accordingly, it is an object of the invention to provide a floating electrical connector having a small height but a high mobility in every direction.

According to the invention there is provided a floating electrical connector which includes a frame-like fixed housing to be secured to a circuit board; a floating housing provided in said fixed housing such that a bottom face of said floating housing is disposed on or near a surface of said circuit board, it is movable relative to said fixed housing in a plane parallel to said circuit board, and that between said fixed and floating housings there is provided a floating space in which said flexible sections are flexed; a plurality of contact elements attached to both said fixed housing and said floating housing having connection sections provided on a side of said fixed housing to be connected to conductors of said circuit board, contact sections provided on a side of said floating housing for contact with contact elements of a mating connector, flexible sections provided between said connection and contact sections to make said floating housing movable; and a receiving cavity provided in said floating housing to receive said mating connector.

In the above floating electrical connector, floating housing is provided within the fixed housing and has the same height as that of the fixing housing. The flexible sections of contact elements are provided within the floating space between the fixed and floating housings so that the resulting connector has a small height.

When a mating connector is plugged in the connector, the regulating sections abut on the mating connector so that the flexible sections are flexed to guide the floating housing to such a position as to align with the mating connector.

It is preferred that the contact elements are made by stamping a metal sheet such that the flexible sections have at least one U-shaped portion to provide a large amount of flexure and a twisting deformation.

DESCRIPTION OF THE PREFERRED EMBODIMENT

Figure 1:
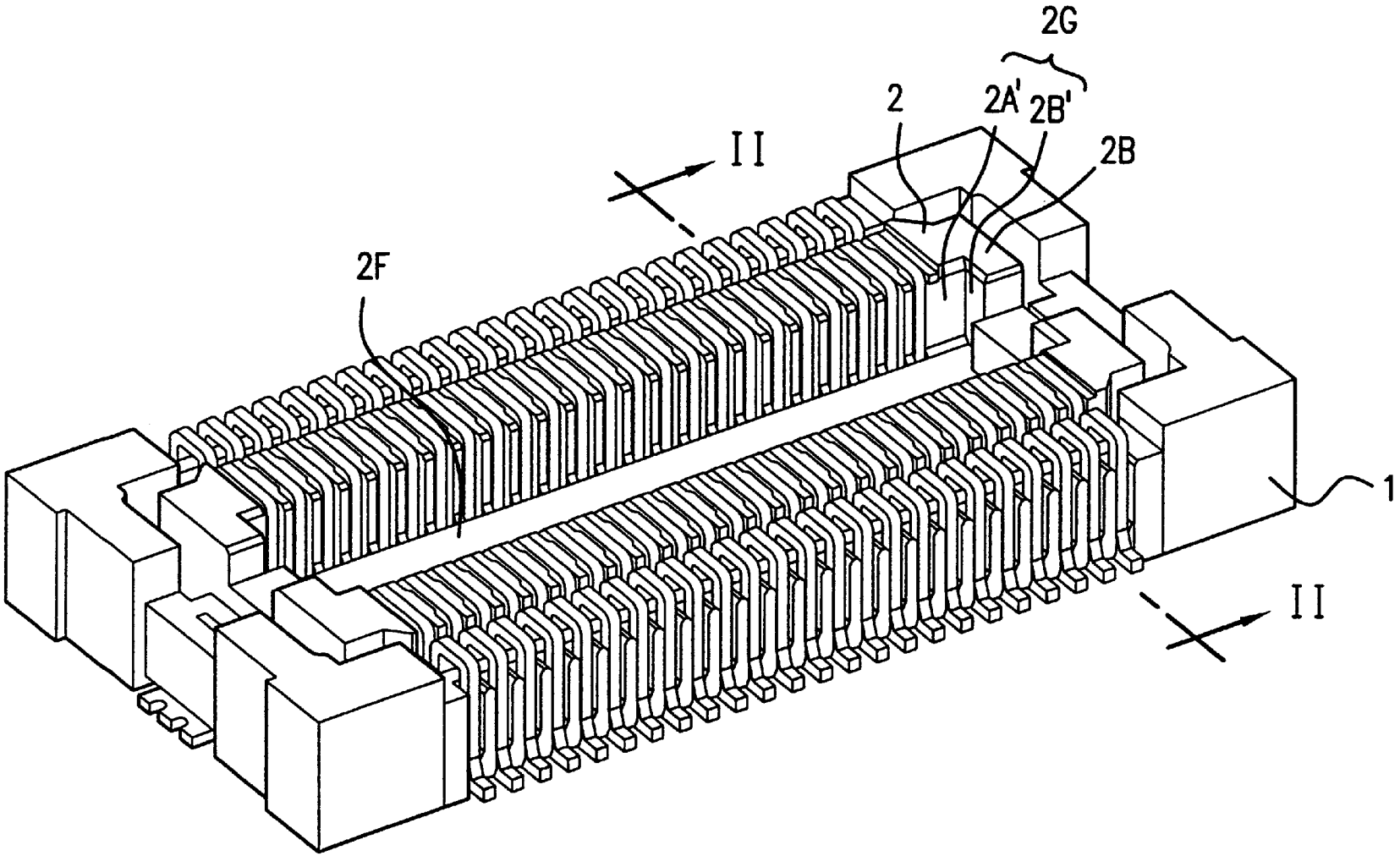
FIG. 1 is a perspective view of a floating electrical connector according to an embodiment of the invention.
Figure 2:
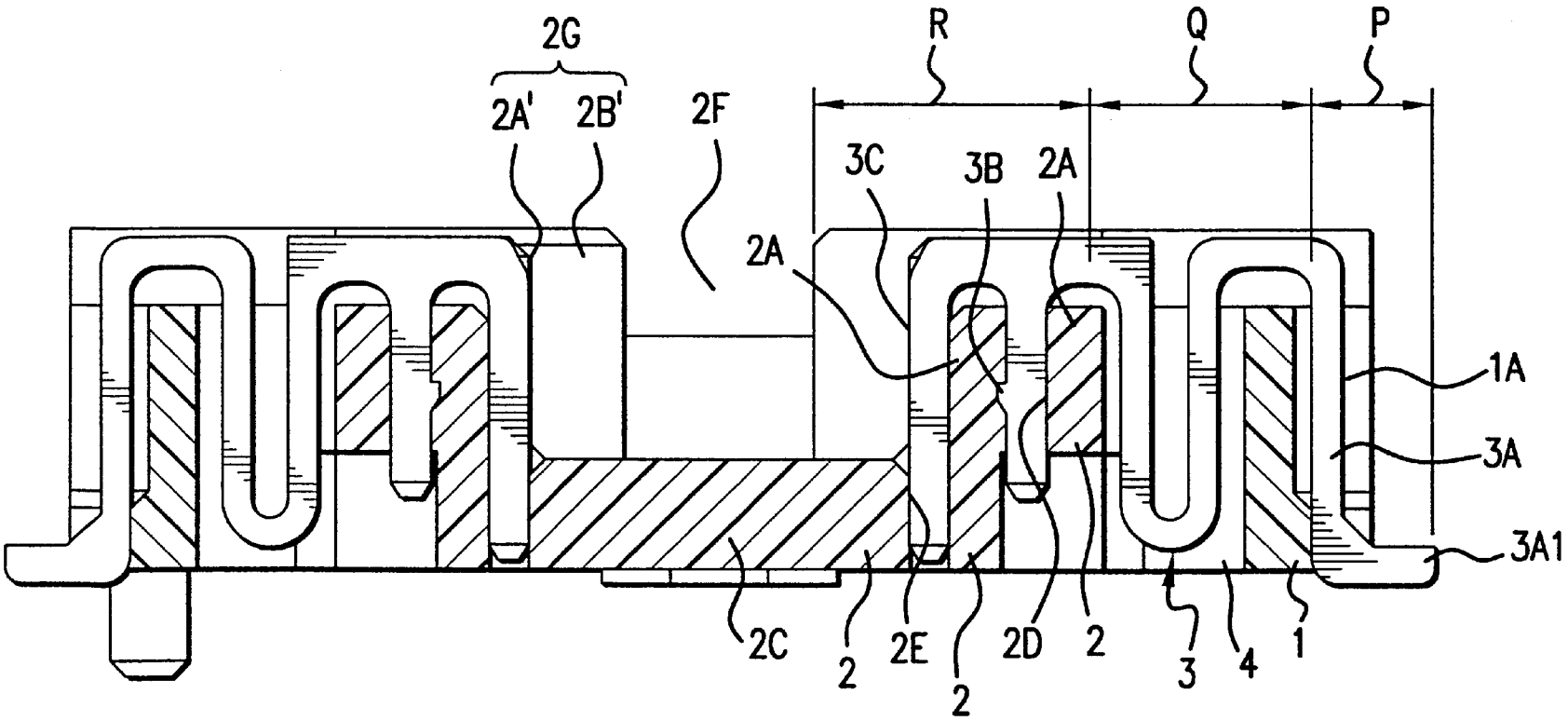
FIG. 2 is a sectional view taken along line II—II of FIG. 1.

In FIGS. 1 and 2, a fixed housing 1 is made in the form of a frame and a floating housing 2 is provided in the fixed housing 1. A plurality of contact elements 3 are made from a metal sheet by stamping and provided between the fixed housing 1 and the floating housing 2 to provide a floating space between them. The flexibility of the contact elements 3 provides the floating housing 2 with mobility.

A plurality of slits 1A are provided in the both side walls of the fixed housing 1 to receive end sections 3A of the contact elements 3. The lower portions of the slits 1A are narrowed to hold firmly the connection portions 3A1 of the end sections 3A.

The floating housing 2 has opposed side walls 2A, linking sections 2B for linking the ends of the side walls 2A, and a bottom section 2C united with the lower portions of the side walls 2A and the linking sections 2B. The bottom face of the bottom section 2C is at substantially the same level as the circuit board (not shown) or the same level as the bottom face of the fixed housing 1. The side walls of the floating housing 2 are as substantially high as the fixed housing 1, and a plurality of retaining slits 2D and 2E are provided in the side walls 2A at positions corresponding to the respective contact elements 3.

The side walls 2A, the linking sections 2B, and the bottom section 2C form a receiving cavity 2F for receiving a mating connector. The inside walls 2A' of the side walls 2A and the inside walls 2B' of the linking sections 2B define regulating portions 2G for guiding the mating connector to the normal position.

The contact elements 3 has a fixing section P on the side of the fixed housing 1, a floating section R on the side of the floating housing 2, and a flexible section Q for linking the both sections P and R. The fixing sections P have an L-shaped form and extends first downwardly in the slit 1A of the fixed housing 1 and then outwardly in the connection portion 3A1. The flexible sections Q have a U-shaped form which contacts neither the fixed housing 1 nor the floating housing 2 within the floating space. The floating sections R extend inward from the flexible section Q and then downward forming a U-shaped two leg portion. One of the legs closer to the flexible section Q is sufficiently wide to be fitted into the retaining slit 2D and has a barb 3B for preventing falling off from the slit, while the other leg is sufficiently wide to be fitted in the retaining slit 2E and has an inner edge 3C serving as a contact portion 3C with a mating connector.

Thus, the contact elements 3 are attached to the fixed housing 1 at the connection sections 3A1 and to the floating housing 2 at the other ends such that the flexible sections Q are flexed within the floating space 4 to provide mobility. The U-shaped flexible sections Q are flexed in the second direction and the floating space 4 extends in the first direction so that the legs of the U-shaped sections Q are flexible relative to each other in the first direction, too. That is, they are flexible in two directions so that the floating housing 2 are flexible relative to the fixed housing 1 in the two directions.

How to use the connector will be described below.

Figure 3:
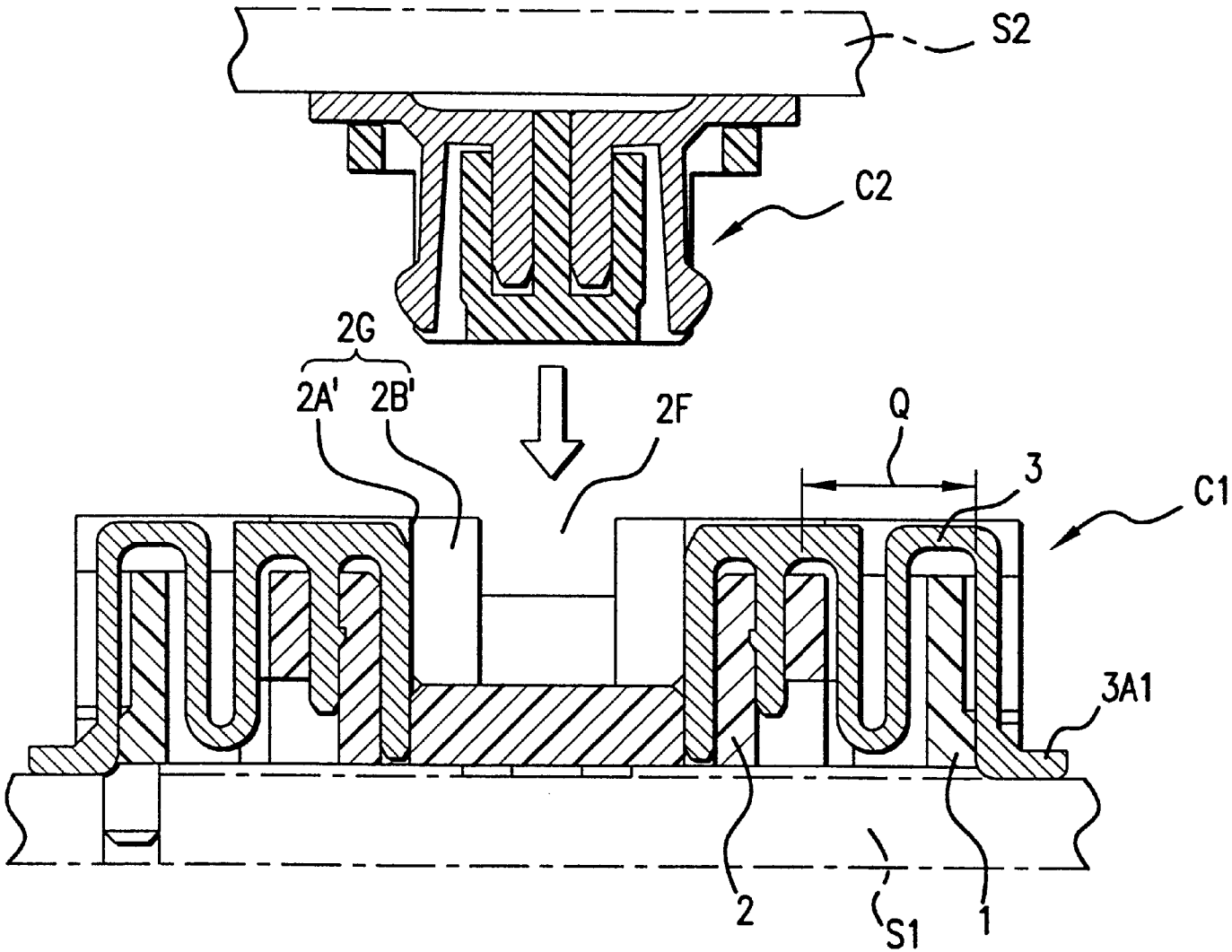
FIG. 3 is a sectional view of the floating electrical connector with a mating connector.

As FIG. 3 shows, the connector C1 is attached to a circuit board S1, and the connection portions 3A1 of contact elements 3 are soldered to the corresponding conductors of the circuit board S1. Usually, a plurality of such connectors are attached to the circuit board S1 at predetermined intervals. A plurality of mating connectors are attached to another circuit board S2 at positions corresponding those of the connectors. However, the actual intervals are not necessarily the same in both the circuit boards S1 and S2 because of attachment errors. Consequently, even if the connector C1 on the circuit board S1 accurately corresponds to the mating connector C2 of the circuit board S2, another connector C1 on the circuit board S1 is offset by the attachment error from a mating connector C2 of the circuit board S2. The connector C1 according to the invention absorbs the error. The connector C1 and the mating connector C2 before plugging in FIG. 3 have such errors.

When the mating connector C2 in such a spacial relationship is plugged into the connector C1, the regulating section of the mating connector C2 abuts on the regulating section 2G (defined by the inside walls 2A' and 2B') of the connector C1, guiding the connector C1 to such a position as to align with the mating connector C2.

The flexible sections Q of contact elements 3 are flexed in the two directions to permit the floating housing 2 to move in the two directions, absorbing the positional error. The floating housing 2 is movable as far as its outside wall hits the inside wall of the fixed housing.

According to the invention, the floating housing 2 is provided within the fixed housing 1 and is almost as low as the fixed housing 1, thus making it possible to provide a connector having a small height and capable of absorbing errors in the two directions.

Figure 4:
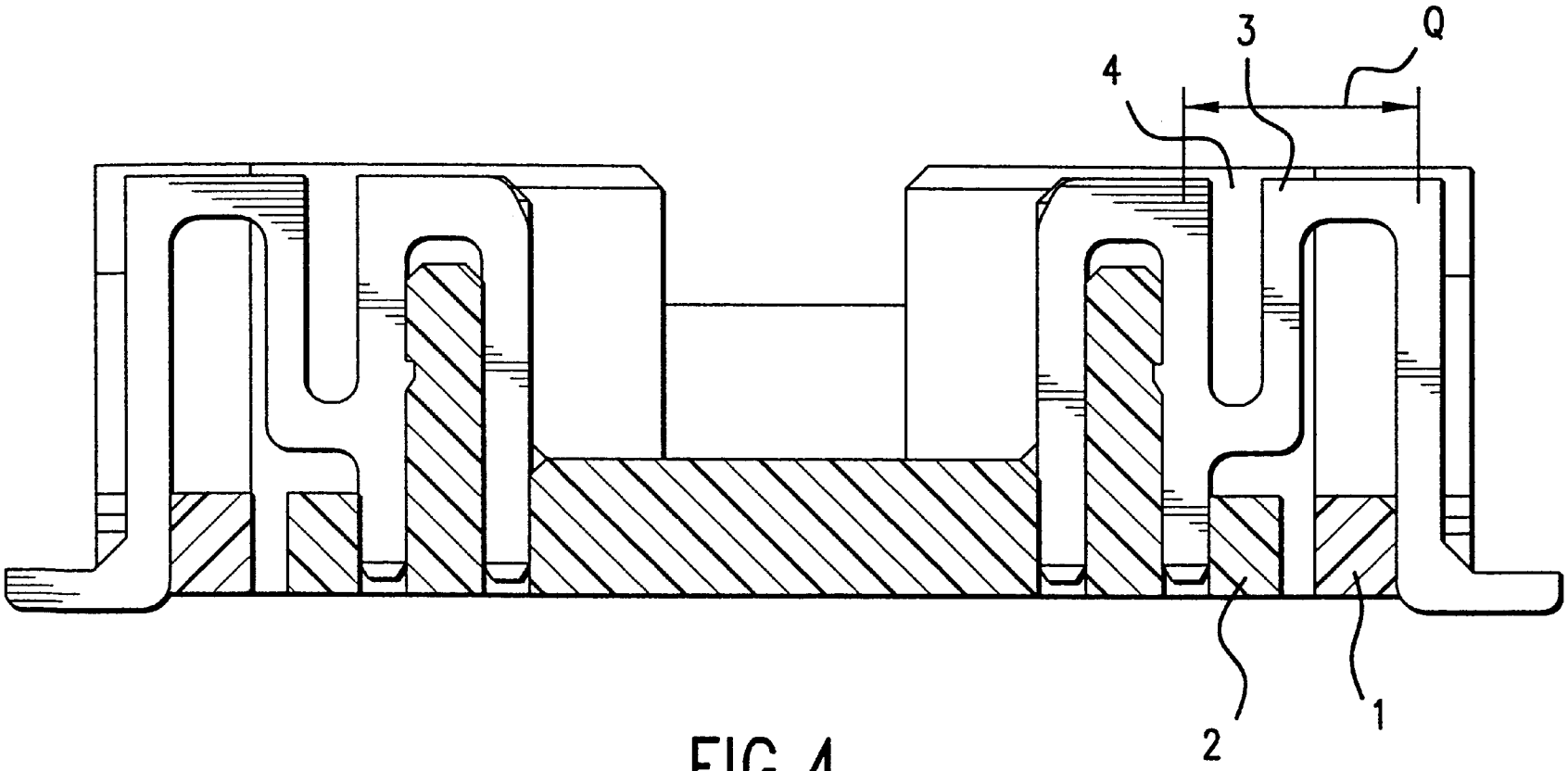
FIG. 4 is a sectional view of a floating electrical connector according to another embodiment of the invention.

In FIG. 4, the contact element 3 according to another embodiment of the invention has a U-shaped flexible section Q which is slightly shorter than that of FIG. 2 so that it is possible to lower the fixed housing 1 and adjacent portions of the floating housing 2 next to the fixed housing 1 and provide a floating space 4 above the adjacent portions, thus minimizing the width (in the second direction) of the connector.

Figure 5:
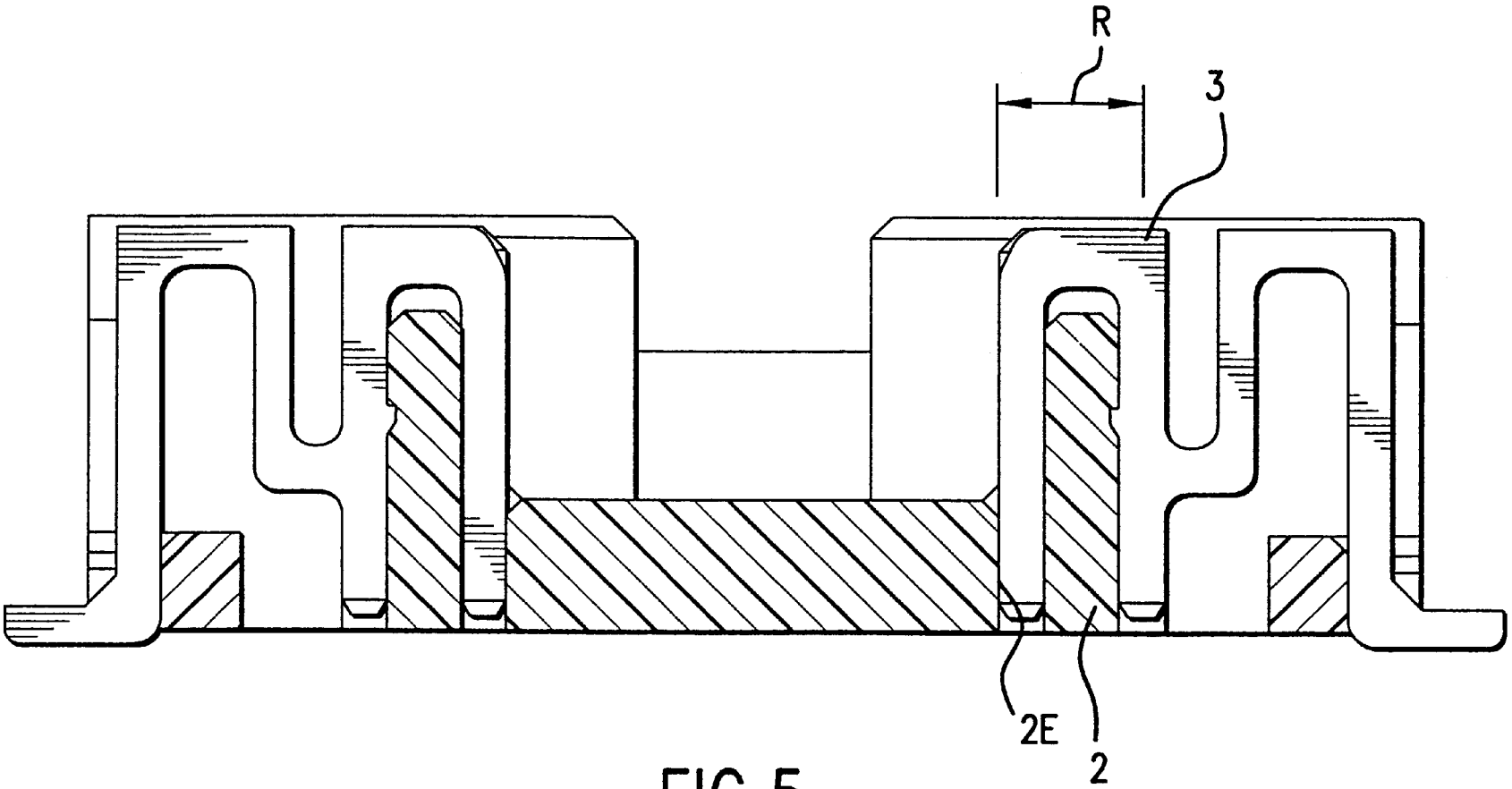
FIG. 5 is a sectional view of a floating electrical connector according to still another embodiment of the invention.
Figure 6:
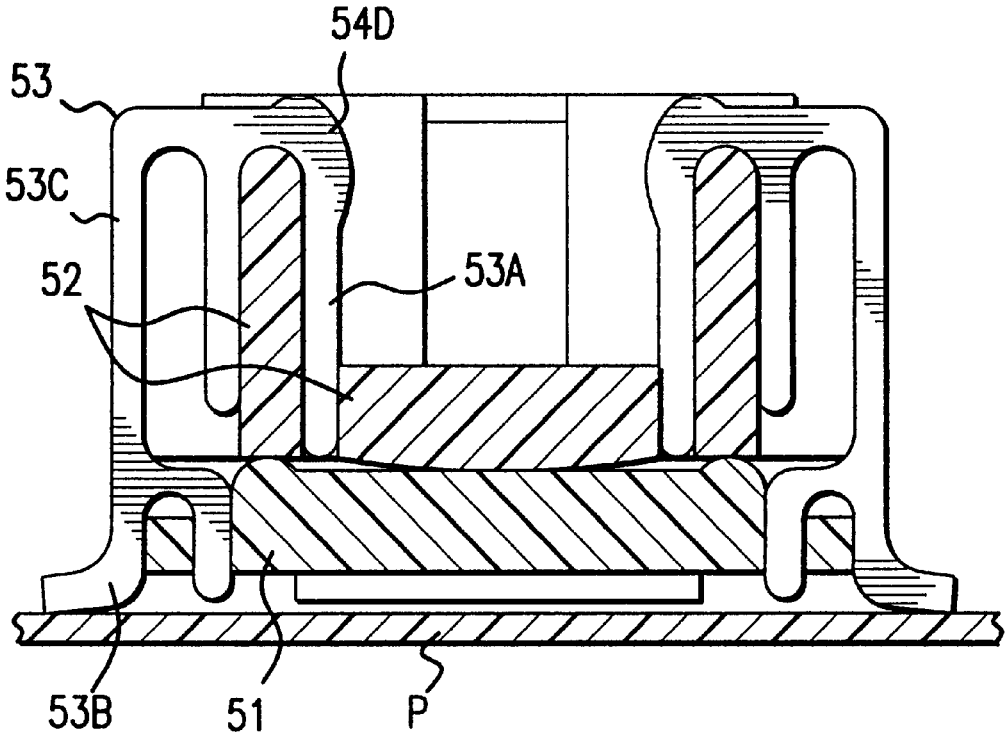
FIG.6 PRIOR ART
FIG. 6 is a sectional view of a conventional connector.
Figure 7:
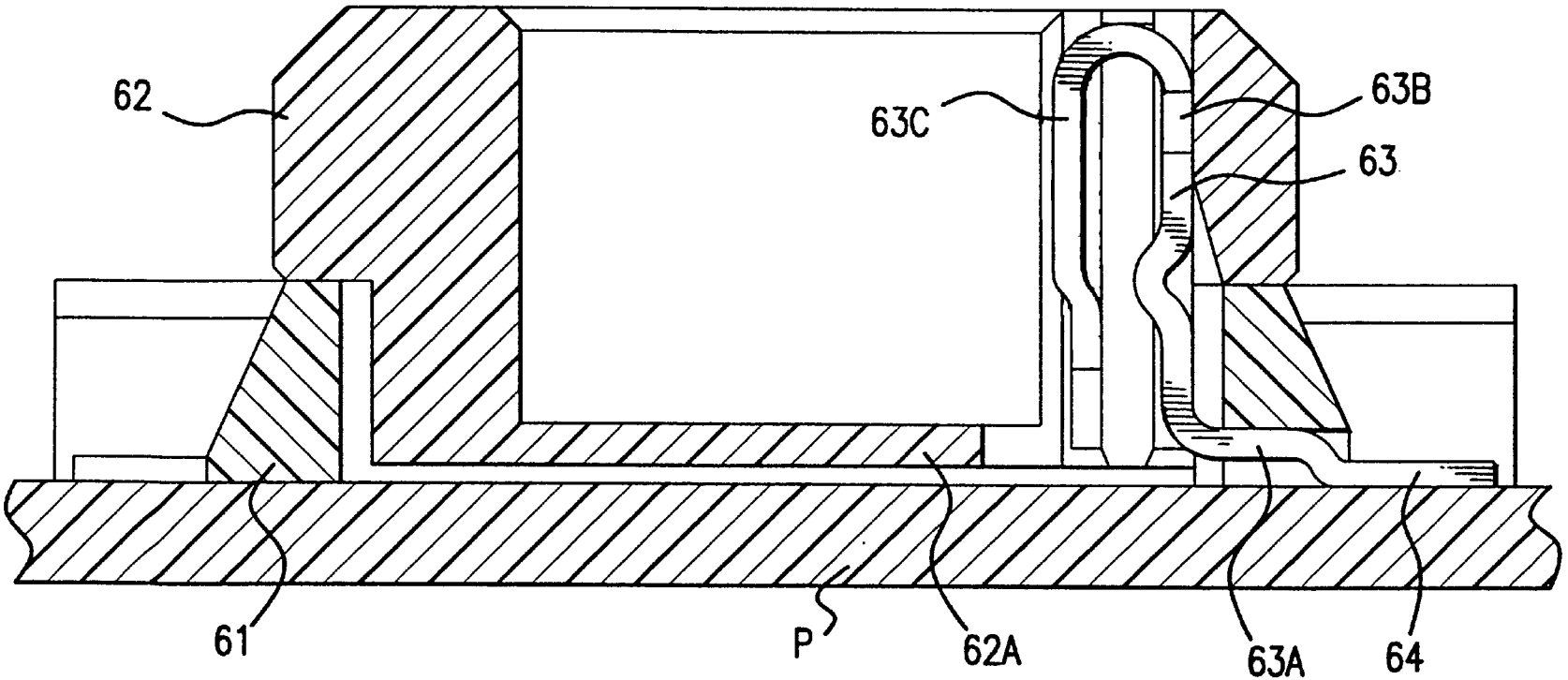
FIG. 7 PRIOR ART
FIG. 7 is a sectional view of another conventional connector.

In FIG. 5, the floating sections R of the contact element 3 is attached to the floating housing 2 at only one retaining slit 2E, further minimizing the width of the connector.

As has been described above, the floating housing is provided within the fixed housing so that it is possible to make both the housings of the same small height. In addition, the flexible sections of contact elements are provided within the floating space between the fixed and floating housings so that the flexible sections are changeable in length and flexible in two directions. Thus, the tolerance in attaching the connectors is maximized in both distance and direction.

What is claimed is:

1. A floating electrical connector, comprising:

a frame-like fixed housings to be secured to a circuit board;

a floating housing provided in said fixed housing such that a bottom face of said floating housing is disposed on or near a surface of said circuit board and is movable relative to said fixed housing in a plane parallel to said circuit board, and that between said fixed and floating housings there is provided a floating space;

a plurality of contact elements attached to both said fixed housing and said floating housing having connection sections provided on a side of said fixed housing to be connected to conductors of said circuit board, contact sections provided on a side of said floating housing for contact with contact elements of a mating connector, and flexible sections provided between said connection sections and contact sections in said floating space to make said floating housing movable; and a receiving cavity provided in said floating housing to receive said mating connector therein, wherein said fixed and floating housing have substantially the same height.

2. A floating electrical connector according to claim 1, wherein each of said flexible sections has at least one U-shaped portion in a plane of the respective contact element.

* * * * *